United States Patent [19]

Finney

[11] 4,103,747

[45] Aug. 1, 1978

[54] BUFFER SPRING FOR AN IMPACT TOOL

[76] Inventor: James L. Finney, 53 Princeton Arms South, Cranbury, N.J. 08512

[21] Appl. No.: 759,600

[22] Filed: Jan. 14, 1977

[51] Int. Cl.[2] ..... B25D 9/00

[52] U.S. Cl. ..... 173/119; 173/139

[58] Field of Search ..... 173/119, 120, 139

[56] References Cited

U.S. PATENT DOCUMENTS

| | | | |
|---|---|---|---|
| 1,553,261 | 9/1925 | Overly | 173/139 |
| 1,609,136 | 11/1926 | Stevens | 173/139 |
| 2,519,477 | 8/1950 | Kind | 173/139 |
| 2,628,599 | 2/1953 | Wilson et al. | 173/139 |
| 3,168,324 | 2/1965 | Kennell | 173/139 |
| 3,924,692 | 12/1975 | Saari | 173/119 |

*Primary Examiner*—Robert A. Hafer

[57] ABSTRACT

A motor driven cam and spring impact tool having a buffer spring for absorbing energy when all of the energy cannot be transmitted out of the working tool into the workpiece. A hammer is carried in the housing and reciprocated by an annular cam and roller assembly. A working tool is aligned with the hammer for transmitting energy from the hammer to the workpiece. A tool guide is carried in the housing and has an axial passage for the working tool. The tool guide has an anvil on the end next to the hammer for receiving blows should the upper end of the working tool be within the axial passage. The tool guide is supported in the housing by an annular buffer ring of spring steel. The buffer is arcuate, allowing it to buckle a selected amount to absorb energy.

6 Claims, 3 Drawing Figures

Fig. 1
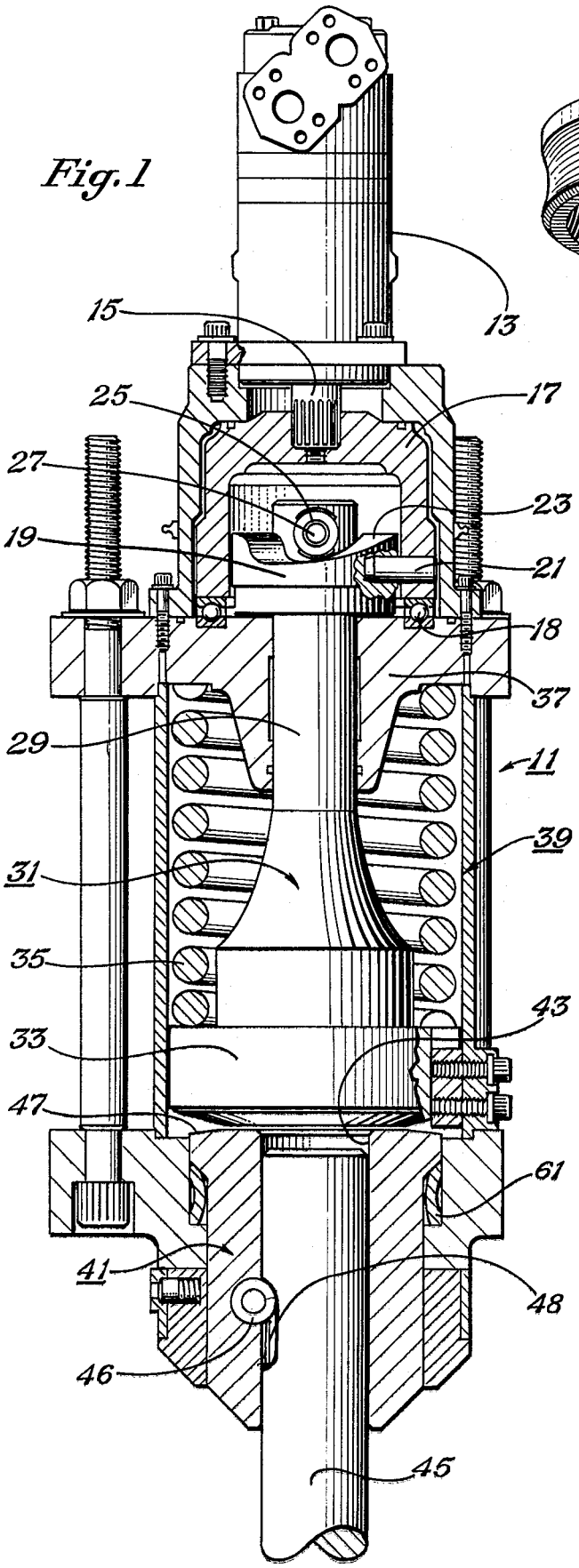
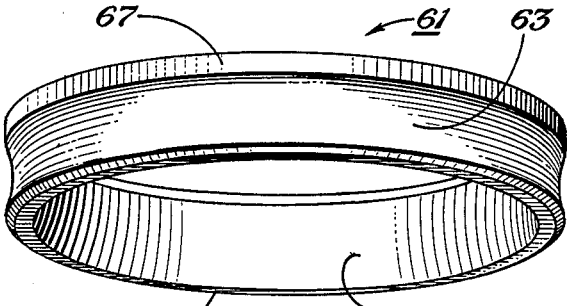
Fig. 2
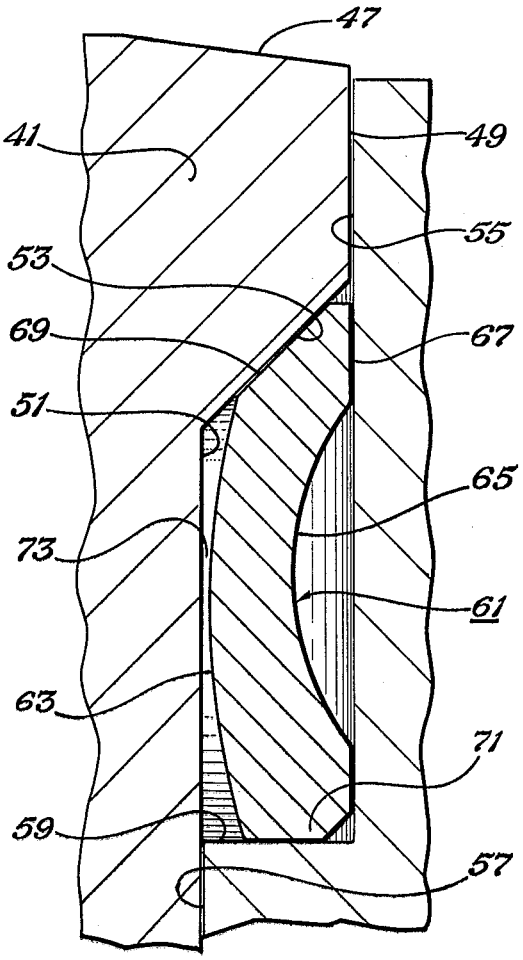
Fig. 3

BUFFER SPRING FOR AN IMPACT TOOL

BACKGROUND OF THE INVENTION

1. Field of the Invention

This invention relates in general to impact tools and in particular to an improved motorized impact tool using a spring and cam to cause reciprocating impacts.

2. Description of the Prior Art

Cam and spring powered impact tools concerned herein are used to deliver powerful reciprocating blows for heavy duty use, such as breaking up very hard formations like rock and concrete. This type of tool is not capable of being held by hand, but is normally mounted to a vehicle, such as a tractor, because of the large amount of energy delivered.

These impact tools have a motor for rotating an annular cam and roller assembly, which translates rotary motion to reciprocating motion. A hammer is connected to the cam and roller assembly for reciprocation, and a large coil spring provides the impact. A working tool is carried slidingly in the housing of the impact tool to transmit the energy from the hammer to the workpiece.

Should the working tool break through the workpiece, or should it not be in solid contact with the workpiece when the blow is delivered, then the energy from the hammer must be dissipated within the tool. Unless there are some means for absorbing the energy, the components will crack and break because of the large impact received.

In the patented prior art, rubber buffers are shown for absorbing blows when the energy cannot be transmitted fully to the workpiece. U.S. Pat. No. 3,179,185 shows a rubber attenuating means for a hand operated impact tool. Hand operated impact tools normally deliver 35–70 foot pounds of energy, while the impact tools of this invention deliver approximately 400 foot pounds of energy. If the energy cannot be transmitted to the workpiece, it must be absorbed by the tool and dissipated through heat from friction. While a rubber buffer may be satisfactory to absorb 35–70 foot pounds of energy, it would be completely unsatisfactory to absorb 400 foot pounds of energy because of the high temperatures generated. Local temperatures resulting from friction to absorb that amount of energy may be as high as 500° to 600° F. Such high temperatures would quickly cause deterioration of any rubber attenuating means.

A spring steel end stop, used with an explosive-driven apparatus for anchoring bolts, nails, and the like is shown in U.S. Pat. No. 3,566,978. In that device, the hammer wedges into a tapered bore in the end stop, expanding the end stop and absorbing a portion of the energy through friction and heat. Other springs cooperate with the expanding end stop to absorb the remainder of the energy. While such an energy absorbing device may be suitable for an explosive-driven impact tool, it is desired to have a less complex arrangement for the motorized impact tool of this invention.

SUMMARY OF THE INVENTION

It is accordingly a general object to provide an improved motor driven cam and spring impact tool. It is a further object of this invention to provide such an impact tool with an improved means for absorbing energy when the energy is not transmittable to the workpiece. It is a further object of this invention to provide such an impact tool with a metal energy absorption means of simple construction.

In accordance with these objects, a cam and spring impact tool is provided that contains a tool guide at the end of the hammer for receiving the working tool. The tool guide has an anvil surface that is struck by the hammer if the end of the working tool should extend lower than the anvil surface, such as if the tool breaks through the workpiece. The tool guide is supported in the housing by a metal buffer ring to absorb any blows that the tool guide receives. The buffer ring is arcuate, and a clearance is provided to allow it to buckle a selected amount to absorb energy. One edge of the ring rubs against the housing wall during the buckling motion to dissipate energy as friction.

BRIEF DESCRIPTION OF THE DRAWINGS

FIG. 1 is an elevational view, partially in section of an impact tool constructed in accordance with this invention.

FIG. 2 is an enlarged perspective view of a buffer ring used with the impact tool shown in FIG. 1.

FIG. 3 is an enlarged cross-sectional view of a portion of the tool guide, buffer ring and housing of the impact tool of FIG. 1.

DESCRIPTION OF THE PREFERRED EMBODIMENT

A cam and spring impact tool 11 constructed in accordance with this invention is shown in FIG. 1. A hydraulic motor 13 has a driving shaft 15 connected to a collar 17 that is in turn supported by the housing on ball bearings 18. An annular cam 19 is carried by the collar 17 through a pair of pins 21 (only one shown) that are spaced apart 180°. The annular cam 19 has a double inclined camming surface 23, upon which a pair of cam rollers 25 are supported. The cam rollers 25 are journaled on an axle 27 that is mounted transversely within shaft 29 of hammer 31. The hammer reciprocates vertically as the cam 19 is rotated with respect to the cam rollers 25. The hammer 31 has an enlarged portion 33 on its striking end. A coil spring 35 encircles shaft 29 and is pre-compressed a selected amount between the enlarged portion 33 and a transverse wall 37 in the housing 39.

A tool guide 41 is carried within the housing 39 at the lower or striking end of the hammer 31. Tool guide 41 is cylindrical with an axial passage 43 for slidingly receiving a moil or working tool 45. A transverse pin 46, between the tool guide and a slot 48 in working tool 45, limits the axial movement of the working tool to a selected distance. Tool guide 41 has an anvil 47 on the end closest to the hammer 31 for receiving blows from the hammer 31 should the working tool 45 be extended so that its upper end is past, or below the anvil 47. This is the position shown in FIG. 1.

As shown in FIG. 3, the anvil 47 is larger in diameter than the remainder of the tool guide, defining an expanded cylindrical wall portion 49 at its perimeter and a reduced cylindrical wall portion 51, separated by a 45° tapered shoulder 53. These portions are closely and slidingly received in a cylindrical bore in housing 39, which has an expanded portion 55 that is in contact with expanded wall portion 49 of the tool guide and a reduced portion 57 that is in contact with the reduced wall portion 51 of the tool guide. The expanded and reduced bores 55, 57 are separated by a ledge 59 that is perpendicular to the impact tool axis and faces toward the hammer 31. The distance from the tapered shoulder 53 to anvil 47, which defines the height of the expanded wall portion 49, is substantially less than the distance from the ledge 59 to the anvil 47. The latter distance is substantially equal to the height of the expanded bore 55.

An annular buffer ring 61, constructed of spring steel, is disposed in the annular space bounded by the ledge 59, tapered shoulder 53, reduced wall portion 51 and expanded bore 55. Referring to FIG. 3, the buffer ring 61 is arcuate with an inner convex wall portion 63 and an outer concave wall porton 65. The outer wall also has a cylindrical wall portion 67 on the edge facing the hammer that is in substantial contact with the expanded bore 55 of the housing, preferably having a 0.010 inch nominal clearance. The inner wall has a tapered portion 69 on the edge that faces the hammer that inclines at the same angle as the tapered shoulder 53 and mates with it. The edge 71 of the buffer ring 61 that is the farthest from hammer 31 is beveled to avoid cracks resulting from sharp corners. The radius of the buffer ring 61 is selected so that edge 71 and cylindrical portion 67 will be substantially in contact with the expanded bore 55. The manufacturing clearance is 0.020 ± 0.020 inch. A clearance is provided between the mid section of the convex wall 63 and reduced wall portion 51 of the tool guide 41 to allow a small amount of buckling of the buffer ring. Preferably the clearance, indicated as numeral 73, is 0.073 ± 0.020 inch.

In operation, the preferred working tool is forced against the workpiece to a selected force of approximately 6000 pounds. This causes the working tool to compress the coil spring or preload it further, extending the upper end of the working tool approximately 3/16 inch above the anvil 47 of the tool guide 41. The motor 13 is then actuated to rotate cam 23, causing the cam rollers 25 to alternately rise and fall. The coil spring 35 urges the piston 31 in the direction of the anvil 47, delivering a blow to the workpiece through the working tool 45. If the proper force of the impact tool against the workpiece is maintained, normally the end of the working tool 45 will not extend within or past the anvil 47, thus the anvil will not receive a blow. Should the working tool break through the workpiece, or the preload force be removed, then the hammer 31 will deliver a blow to the anvil 47. The blow is transmitted into the buffer ring 61, causing it to buckle along the vertical axis, and allowing the tool guide 41 to move down with respect to the housing 39. When the midsection of the convex wall 63 contacts the tool guide, movement ceases in the downward direction, and the guide begins to return back to its normal position. This deflection spreads the blow interval as felt by the remaining parts of the device. Also friction heat is generated at the contacting surfaces of the tapered shoulder 53 and tapered portion 69 of the ring, and the contacting surfaces between the cylindrical portion 67 of the ring and the expanded bore 55. The tapered shoulder 53 directs a component of the blow from the hammer in the direction toward the expanded bore 55, to increase the friction between the cylindrical portion 67 of the ring and expanded bore 55, as the ring is buckled or compressed in the vertical direction. Frictional heat generated may be 500° to 600° F in the local area. The anvil 47 will continue to receive the blows from the hammer until the tool 45 again returns to its preload position with its end above the anvil 47.

It should be apparent that an invention having significant improvements has been provided. A heavy duty impact tool is provided that has a buffer means for dissipating energy when the working tool is unable to deliver the energy fully to the workpiece. The buffer ring, being of spring steel, is not susceptible to deterioration from the heat generated by friction. The tool guide and buffer ring absorb a large amount of energy, yet are of simple construction.

While the invention has been shown in only one of its forms, it should be apparent to those skilled in the art that it is not so limited but is susceptible to various changes and modifications without departing from the spirit thereof.

I claim:

1. In an impact tool having a housing, a hammer positioned in the housing for axial movement with respect to the housing, a working tool carried in an axial alignment with the hammer for transmitting energy received from the hammer to a workpiece, and means for reciprocating the hammer, the improvement comprising:

a tool guide carried in the housing, having an axial passage for slidingly receiving the working tool, an anvil for receiving blows from the hammer should the working tool be extended so that its end that contacts the hammer is within the axial passage of the anvil, and reduced and expanded cylindrical wall portions separated by a shoulder that faces away from the hammer; and an annular metal buffer ring encircling the reduced wall portion between the shoulder and an annular internal ledge in the housing; the buffer ring having an inner convex wall portion and an outer concave wall portion, with a selected clearance being provided between the reduced wall portion and the inner wall portion, for allowing the buffer ring to buckle a selected amount, corresponding to an axial movement of the tool guide caused by the blow, thereby absorbing a portion of the energy;

the shoulder being inclined with respect to the axis of the tool, and the buffer ring having a mating inclined surface; the shoulder facing generally the outer concave wall portion to urge the outer edges of the buffer ring against the inner wall of the housing.

2. The apparatus according to claim 1 wherein the buffer ring is spring steel.

3. In a motor driven cam and spring impact tool having a housing, a hammer positioned in the housing for axial movement with respect to the housing, an annular cam and roller assembly for translating rotational motion to reciprocational motion for the hammer, means for supplying rotational motion to the cam and roller assembly, and a working tool carried in an axial alignment with the hammer for transmitting energy received from the hammer to a workpiece, the improvement comprising:

a tool guide carried in the housing, having an axial passage for slidingly receiving the working tool, an anvil for receiving blows from the hammer should the working tool be extended so that its working end is below the anvil, reduced and expanded cylindrical wall portions separated by a tapered shoulder that faces away from the hammer;

the housing having reduced and expanded cylindrical bore portions separated by a ledge that faces toward the hammer; the enlarged wall portion of the tool guide being of less height than the expanded bore portion of the housing, defining an annular space bounded by the tapered shoulder, ledge, expanded bore portion and reduced wall portion of the tool guide; and an annular metal buffer ring carried in the annular space; the buffer ring having an inner convex wall portion and an outer concave wall portion; the outer wall of the buffer ring also having a cylindrical band on the edge that is closest to the hammer; the inner wall of the buffer ring also having an annular tapered portion that mates with the tapered shoulder of the tool guide; the radius of the convex-concave wall portions being of a size to provide a selected clearance between the reduced wall portion of the tool guide and the midsection of the convex wall portion, whereby a blow delivered to the anvil of the tool guide causes the tool guide to move down with respect to the housing, buckling the buffer ring until the clearance is closed, and rubbing the cylindrical band of the buffer ring against the expanded bore of the housing, thereby spreading the time interval of the blow and absorbing and dissipating energy through friction.

4. In a motor driven cam and spring impact tool having a housing, a hammer positioned in the housing for axial movement with respect to the housing, an annular cam and roller assembly for translating rotational motion to reciprocational motion for the hammer, means for supplying rotational motion to the cam and roller assembly, and a working tool carried in an axial alignment with the hammer for transmitting energy received from the hammer to a workpiece, the improvement comprising:

a tool guide axially carried in the housing, having an axial passage for slidingly receiving the working tool, an anvil for receiving blows from the hammer should the working tool be extended so that its end closest to the hammer is past the anvil, an enlarged annular shoulder at the perimeter of the anvil, and a cylindrical reduced wall portion adjacent the shoulder; and an annular metal buffer ring encircling the reduced wall portion of the tool guide between the shoulder and an internal ledge in the housing with one edge of the buffer ring in contact with the shoulder and the other edge in contact with the ledge; the buffer ring being arcuate in vertical cross-section and spaced between the reduced wall portion and housing so as to deflect a selected amount under the force of a blow, for absorbing a portion of the energy caused by a blow on the tool guide;

the buffer ring having a convex inner wall portion and a concave outer wall portion, with the inner wall spaced a selected distance from the reduced wall portion of the tool guide so as to allow a selected amount of buckling;

the shoulder being tapered and facing in the direction away from the hammer, the buffer ring having a mating tapered portion;

the outer wall of the buffer ring having a cylindrical band, adjacent the edge in contact with the shoulder, that frictionally engages the housing when a blow is delivered and as the buffer ring buckles, dissipating a portion of the energy delivered as frictional heat.

5. In an impact tool having a housing, a hammer positioned in the housing for axial movement with respect to the housing, a working tool carried in an axial alignment with the hammer for transmitting energy received from the hammer to a workpiece, and means for reciprocating the hammer, the improvement comprising:

a tool guide axially carried in the housing having an axial passage for slidingly receiving the working tool, an anvil for receiving blows from the hammer should the working tool be extended so that its end closest to the hammer is past the anvil, an enlarged annular shoulder at the perimeter of the anvil, and a cylindrical reduced wall portion adjacent the shoulder, and an annular metal buffer ring encircling the reduced wall portion of the tool guide between the shoulder and an internal ledge in the housing; the buffer ring being arcuate in vertical cross-section and spaced between the reduced wall portion and housing so as to deflect a selected amount under the force of a blow, for absorbing a portion of the energy caused by a blow on the tool guide;

the shoulder being inclined with respect to the axis of the tool, and the buffer ring having a mating inclined surface.

6. In an impact tool having a housing, a hammer positioned in the housing for axial movement with respect to the housing, a working tool carried in an axial alignment with the hammer for transmitting energy received from the hammer to a workpiece, and means for reciprocating the hammer, the improvement comprising:

a tool guide axially carried in the housing, having an axial passage for slidingly receiving the working tool, an anvil for receiving blows from the hammer should the working tool be extended so that its end closest to the hammer is past the anvil, an enlarged annular shoulder at the perimeter of the anvil that is tapered and facing in the direction away from the hammer, and a cylindrical reduced wall portion adjacent the shoulder, and an annular metal buffer ring encircling the reduced wall portion of the tool guide between the shoulder and an internal ledge in the housing with one edge of the buffer ring having a mating tapered portion in contact with the shoulder and the other in contact with the ledge; the buffer ring having a convex inner wall portion and a concave outer wall portion, with the inner wall spaced a selected distance from the reduced wall portion of the tool guide so as to allow a selected amount of buckling.

* * * * *